US011383371B2

(12) United States Patent
Wu et al.

(10) Patent No.: US 11,383,371 B2
(45) Date of Patent: Jul. 12, 2022

(54) MULTI-FUNCTIONAL TELESCOPIC DEVICE

(71) Applicant: Fengliang Li, Tianjing (CN)

(72) Inventors: Mengke Wu, Tianjing (CN); Fengliang Li, Tianjing (CN); Ge Zhang, Tianjing (CN); Zefeng Liu, Tianjing (CN)

( * ) Notice: Subject to any disclaimer, the term of this patent is extended or adjusted under 35 U.S.C. 154(b) by 662 days.

(21) Appl. No.: 16/425,830

(22) Filed: May 29, 2019

(65) Prior Publication Data

US 2019/0366530 A1 Dec. 5, 2019

(30) Foreign Application Priority Data

May 29, 2018 (CN) ..... 201810529045.6
May 29, 2018 (CN) ..... 201820810313.7

(51) Int. Cl.
*B25G 1/04* (2006.01)
*B25B 23/16* (2006.01)

(52) U.S. Cl.
CPC ..... *B25G 1/04* (2013.01); *B25B 23/16* (2013.01)

(58) Field of Classification Search
CPC ..... B25G 1/04; B25G 1/06; B25B 23/16
See application file for complete search history.

(56) References Cited

U.S. PATENT DOCUMENTS 4,960,015 A * 10/1990 Mathews ..... B25G 1/04 81/177.2
8,806,720 B2 * 8/2014 Wang ..... A01G 3/0251 30/341
2018/0009099 A1 * 1/2018 Resh ..... B25G 1/04
2020/0156235 A1 * 5/2020 Su ..... B25G 1/06

FOREIGN PATENT DOCUMENTS

DE 19617365 A1 * 11/1996 ..... A01G 3/083

* cited by examiner

*Primary Examiner* — David B. Thomas
(74) *Attorney, Agent, or Firm* — Novoclaims Patent Services LLC; Mei Lin Wong

(57) ABSTRACT

A multi-functional telescopic device which includes a front hand grip cylinder element at a front end with a button, a middle hand grip cylinder element at a middle, a rear cylinder element at a tail end opposite to the front end, and a tail fastener; a middle layer fixed sleeve element connecting communicating with the middle hand grip cylinder element for sliding movement; an extensible tube comprising a threaded connecting head at a front end arranged for connecting to a tool head and a rack at a top side thereof, and is capable of sliding movement for length extension or length shortening initiated by a movement of the middle hand grip cylinder element, wherein the button is arranged for engaging with the rack at a fixed-length state and for disengaging with the rack at a length adjustment state.

20 Claims, 5 Drawing Sheets

MULTI-FUNCTIONAL TELESCOPIC DEVICE

CROSS REFERENCE OF RELATED APPLICATION

This is a non-provisional application which claimed priority of Chinese application number 2018105290456, filing date May 29, 2018; and 2018208103137, filing date May 29, 2018. The contents of these specifications are incorporated herein by reference.

BACKGROUND OF THE PRESENT INVENTION

Field of Invention

The present invention relates a multi-functional handheld rod tool, and particularly to a multi-functional extensible or telescopic device.

Description of Related Arts

At present, the demand for telescopic rods in the renovation and remodeling tool industry is increasing. With the advancement and development of science and technology, the requirements for telescopic rods are also higher and higher. At present, most of the telescopic rods on the market employ sleeve mechanisms, which are fixed into position by the expansion block at the bottom of the inner sleeve, or by the limit button, and the structure is simple. However, the expansion block and the limit button often become stuck or damaged during use, which shortens the service life of the telescopic rod and affects the use.

SUMMARY OF THE PRESENT INVENTION

In order to solve the problems of existing arts, an object of the present invention is to provide a multi-purpose telescopic device to realize a stepless displacement of the telescopic device and bi-directional telescoping which has the advantages of simple principle, sophisticated design, and secure positioning.

Additional advantages and features of the invention will become apparent from the description which follows, and may be realized by means of the instrumentalities and combinations particular point out in the appended claims.

According to the present invention, the foregoing and other objects and advantages are attained by the followings:

A multifunctional telescopic device, comprising:

an outermost layer which sequentially comprises a front hand grip cylinder element 1 at a front end 101, a middle hand grip cylinder element 2 at a middle, a rear cylinder element 3 at a tail end 102 opposite to the front end 101, and a tail fastener 4;

a middle layer which comprises a middle layer fixed sleeve element 9 connecting between the front hand grip cylinder element 1 and the middle hand grip cylinder element 2 such that the middle hand grip cylinder element 2 and the rear cylinder element 3 are capable of sliding along a longitudinal direction of the middle layer fixed sleeve element 9;

an innermost layer which comprises an extensible tube 8 provided inside the front hand grip cylinder element 1 and the middle hand grip cylinder element 2 capable of extending outside the front hand grip cylinder element 1 and comprising a threaded connecting head 5 at the front end 101, and a rack 7 at a top side thereof, wherein the front hand grip cylinder element 1 comprises a button 6 having a teeth structure arranged for engaging with the rack of the extensible tube 8 at a fixed-length state at which the length of the multifunctional telescopic device is fixed and for disengaging with the rack of the extensible tube 8 at a length adjustment state at which the length of the multifunctional telescopic device is free to adjust, wherein a sliding movement of the extensible tube 8 for length extension or length shortening is driven through a movement of the middle hand grip cylinder element 2 by a transmission arrangement.

The transmission arrangement comprises a position sleeve 13 fixedly connected inside the tail fastener 4; a drive plate 11 positioned inside the rear cylinder element 3, a left transmission guiding half cylinder member 10 and a right transmission guiding half cylinder member 22 at the innermost layer supported by the middle layer fixed sleeve element 9; a positioning sliding block 12 provided at the left transmission guiding half cylinder member 10 and the right transmission guiding half cylinder member 22 inside the front hand grip cylinder element 1; and a wire rope 18 having one end connecting to the drive plate 11 through the sliding block 12 and another end connecting to the wire rope fastening sleeve 14 which is positioned at the tail end of the extensible tube 8.

The extensible tube 8 has a cylindrical hollow body and is indented along a longitudinal length thereof at two opposite top and bottom sides to form an upper groove 81 and a lower groove 82 respectively. The rack 7 is positioned at the upper groove 81 while a left bearing connecting rod 16 and a right bearing connecting rod 17 are guided by the lower groove 82 having one end fixedly connected to the front end of the left transmission guiding half cylinder member 10 and the right transmission guiding half cylinder member 22 and another end supporting a second bearing 19 which is positioned at an inner side of the front hand grip cylinder element 1. A wire rope fastening sleeve 14 is positioned at the tail end of the extensible tube 8.

The front hand grip cylinder element 1 comprises a positioning protrusion 111 at the front end and inner side thereof for restricting sliding movement of the middle layer fixed sleeve element 9.

The extensible tube 8 has a cylindrical hollow body.

The left transmission guiding half cylinder member 10 and the right transmission guiding half cylinder member 22 are connected together to form a complete cylindrical hollow sleeve and forming a hollow guiding rail therein, the drive plate 11 has a front end affixed at the hollow guiding rail formed by the left transmission guiding half cylinder member 10 and the right transmission guiding half cylinder member 22 through the positioning sliding block 12.

The front hand grip cylinder element 1 is formed by two cylinder members.

The button 6 comprises a spring 61 and has a teeth structure 62 at a front inner side 63, the teeth structure 62 is engaged with the rack 7 at the fixed-length state and the spring 61 is compressed to disengage the teeth structure 62 from the rack to allow movement at the length adjustment state.

The left bearing connecting rod 16 and the right bearing connecting rod 17 are connected together to form a rod structure having a rectangular cross-section.

The advantageous effect of the present invention:

The principle of the invention is simple. The wire rope is fixed on the innermost layer and the outermost layer of the three-layered rods, and the innermost and outermost portions of the rod are extended in the opposite direction respectively by the wire rope transmission to realize the extension and retraction action of the rod for extending and shortening the length of the rod. The invention realizes the stepless extension and retraction of the telescopic rod by the engagement of the rack of the inner rod and the teeth structure of the outer spring button. The threaded head at the front end of the telescopic rod can be connected to any tool that needs to be extended and its application can be very widely used.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

Figure 1:
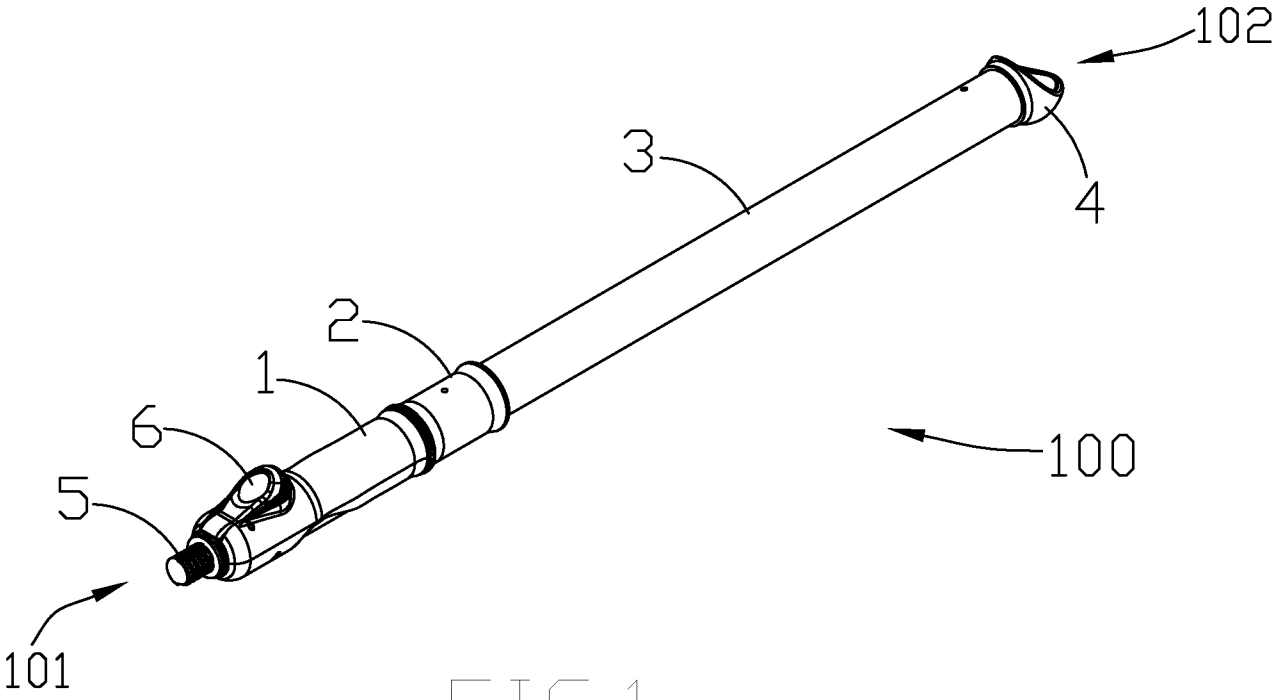
FIG. 1 is a schematic diagram showing a shorten state of the telescopic tube according to a preferred embodiment of the present invention.

The present invention is further described with the accompanying drawings as follows.

Referring to FIGS. 1 to 5 of the drawings, the multi-functional telescopic device 100 of the present invention, such as a telescopic rod or a telescopic tube, has a three-layered structure. The outermost layer is the first layer. The middle layer is the second layer. The innermost layer is the third layer.

According to the present invention, the outermost layer of the multi-functional telescopic device comprises: a front hand grip cylinder element 1 provided at a front end 101, a middle hand grip cylinder element 2 provided at the middle, a rear cylinder element 3 provided at a tail end 102 opposite to the front end, and a tail fastener 4. The front hand grip cylinder element 1 comprises a button 6 at its outer surface. The middle layer comprises a middle layer fixed sleeve element 9. The innermost layer comprises an extensible tube 8, a left transmission guiding half cylinder member 10, and a right transmission guiding half cylinder member 22. The left transmission guiding half cylinder member 10 and a right transmission guiding half cylinder member 22 are arranged to couple together to form a complete cylindrical sleeve. The provision of the left transmission guiding half cylinder member 10 and the right transmission guiding half cylinder member 22, which are two half cylinders arranged for forming a complete cylindrical sleeve, is designed for assembly convenience. The extensible tube 8 have one end comprising a threaded connecting head 5. The threaded connecting head 5 is capable of connecting to different tools, such as renovation and remodeling tools, which require length adjustment. For the ease of assembly, the front hand grip cylinder element 1 comprises two cylinder members 15, which are an upper cylinder and a lower cylinder member, arranged for assembling together to form the front hand grip cylinder element 1.

Figure 2:
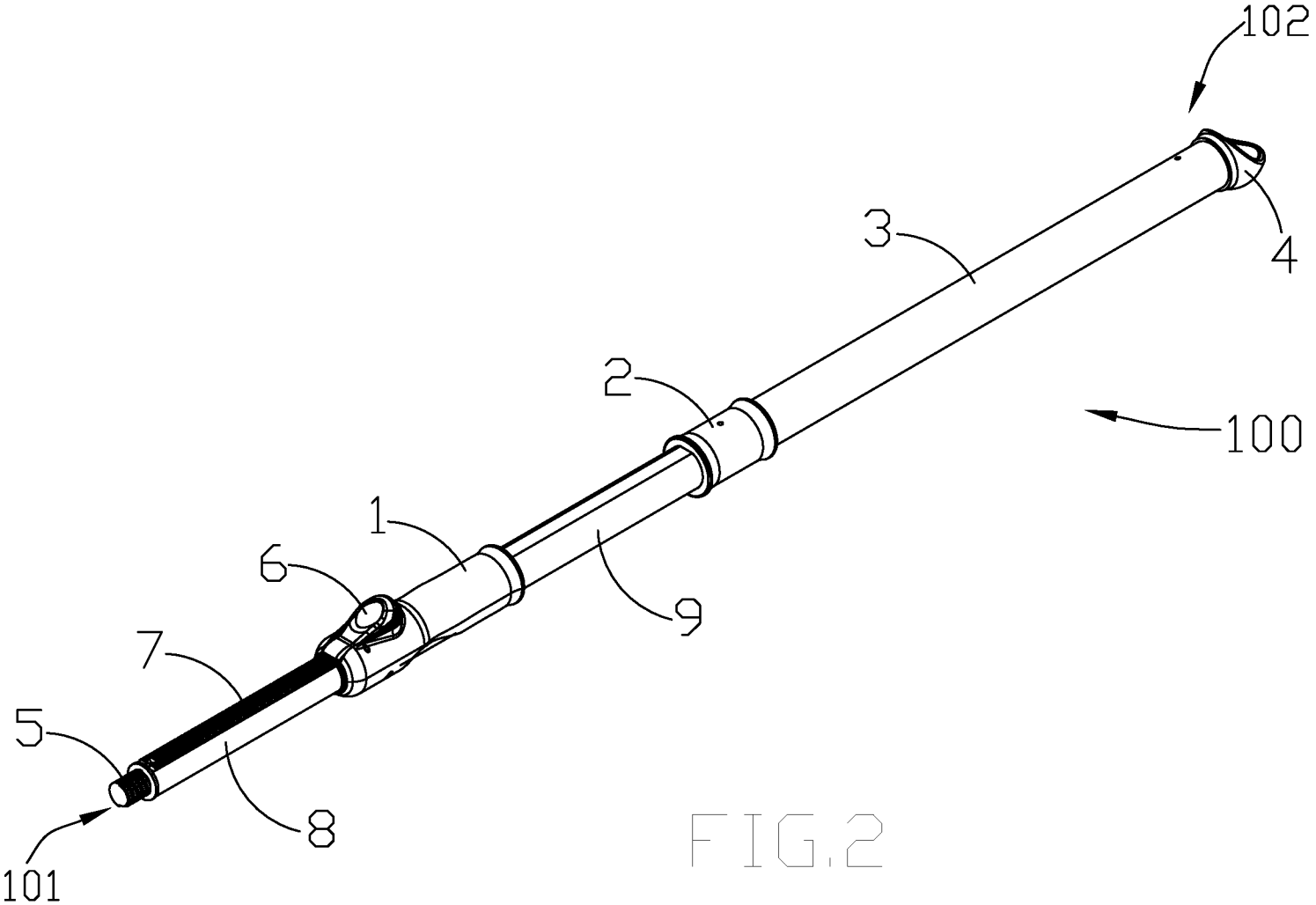
FIG. 2 is a schematic diagram showing an extended state of the telescopic tube according to the above preferred embodiment of the present invention.
Figure 3:
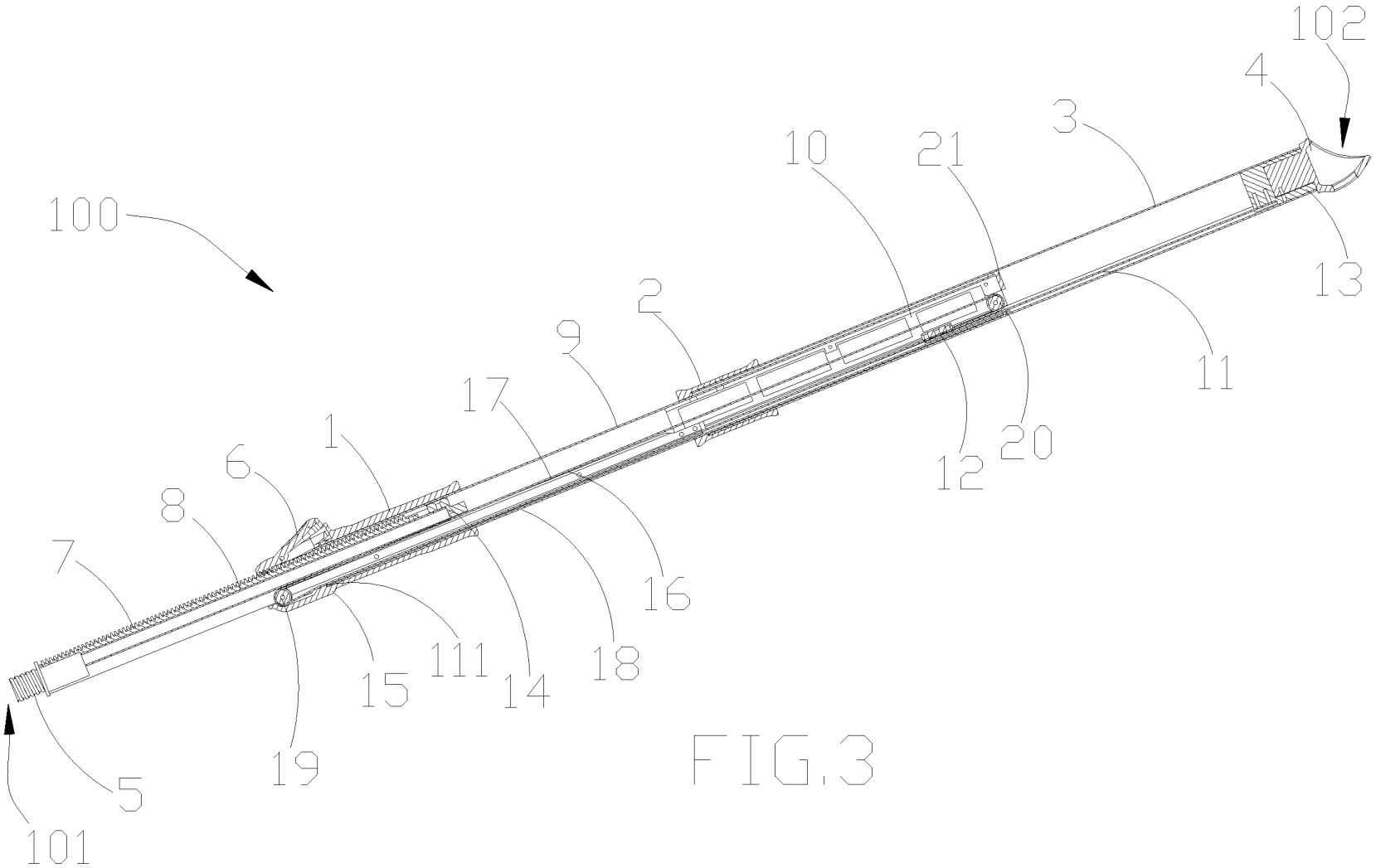
FIG. 3 is a schematic sectional view showing an extended state of the telescopic tube according to the above preferred embodiment of the present invention.
Figure 4:
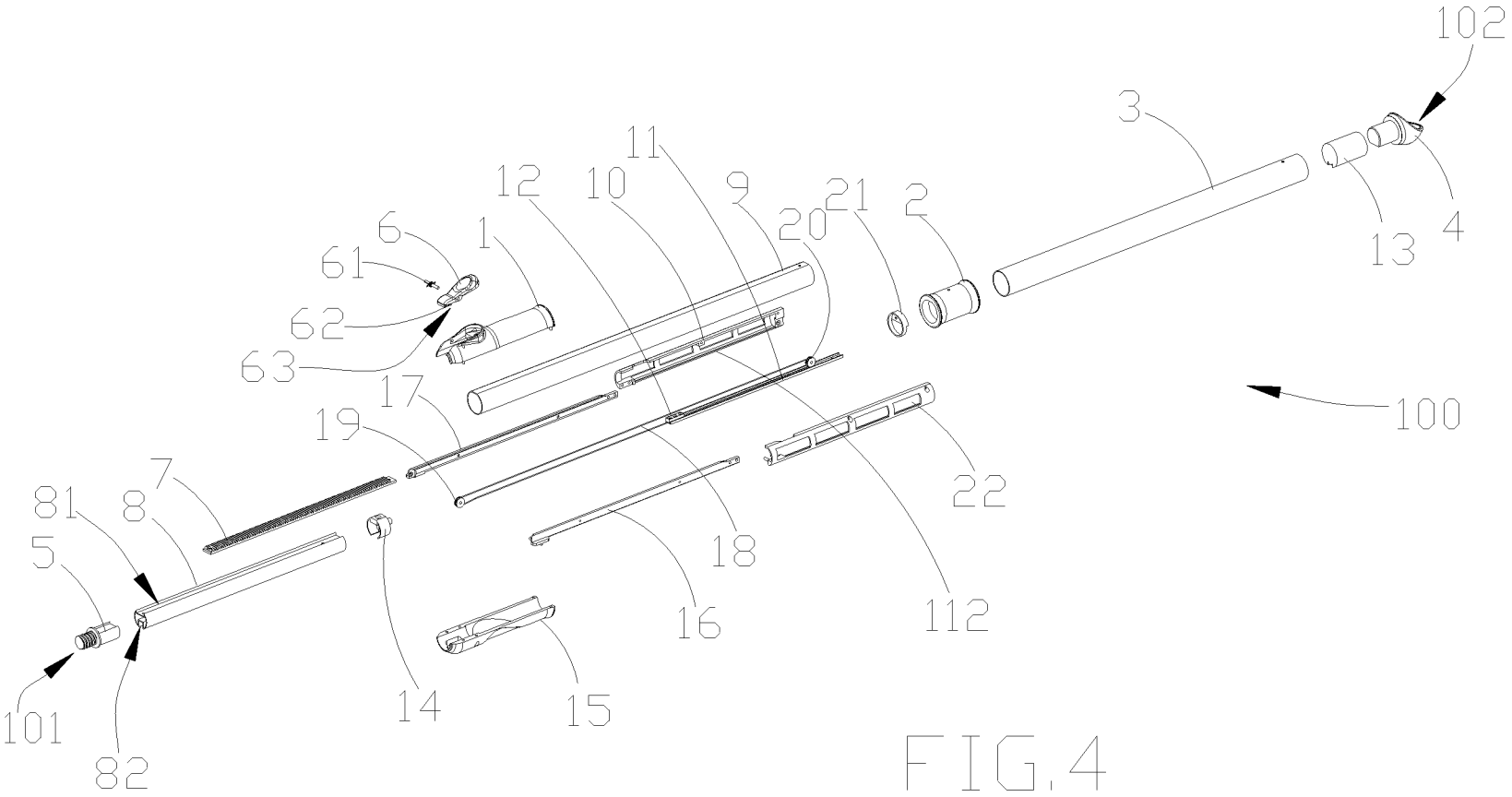
FIG. 4 is an exploded view of the telescopic tube according to the above preferred embodiment of the present invention.
Figure 5:
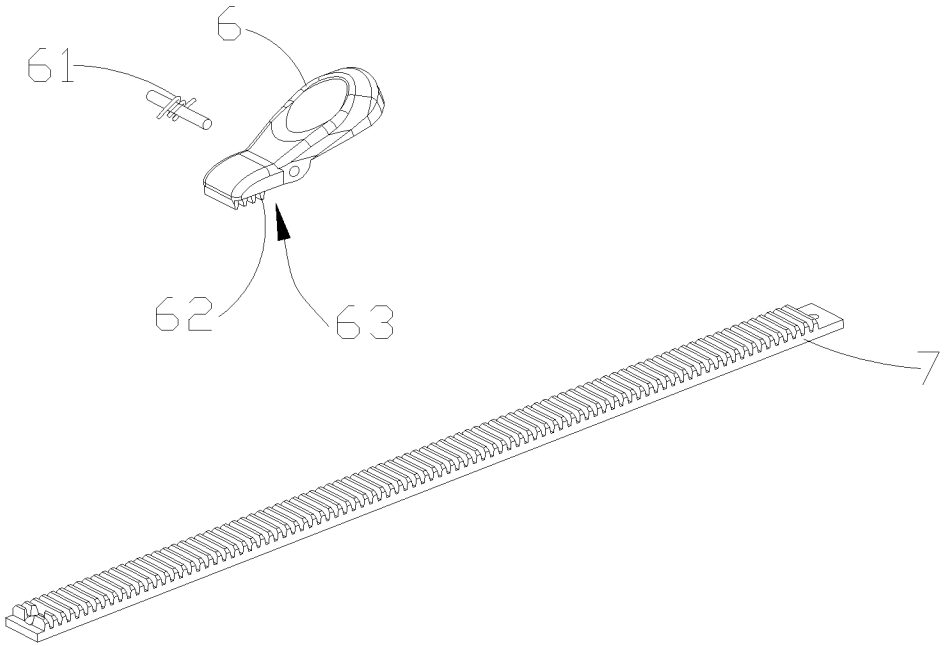
FIG. 5 is a schematic diagram showing the rack and the button of the telescopic tube according to the above preferred embodiment of the present invention.

Referring to FIG. 2 of the drawings, the extensible tube 8 is positioned at an inner side of the front hand grip cylinder element 1 and the middle hand grip cylinder element 2 and comprises a rack 7. The button 6 is a spring button comprising a spring 61 and has a teeth structure 62 at a front inner side 63 to engage with the rack 7, as shown in FIGS. 3 to 5 of the drawings (FIG. 5 is the enlarged view of the button 6 and the rack 7 of the present invention). Under a normal condition, which is defined as a fixed-length state, the button 6 is engaged with the rack 7 under a spring action such that the extensible tube 8 is affixed into a particular position with a fixed length. When the button 6 is pressed downwardly, the spring 61 of the button 6 is compressed and the teeth structure 62 at the front inner side is disengaged with the rack 7, then the extensible tube 8 can be extended or shortened freely, which is defined as a length adjustment state. When the extensible tube 8 is extended to a target length, the button 6 is released and then the teeth structure 62 at the front inner side 63 of the button 6 will engage with the rack 7 again such that the extensible tube 8 is affixed into position again.

Referring to FIGS. 3-4 of the drawings, the extensible tube 8 has an upper groove 81 and a lower groove 82. In particular, the extensible tube 8 has a cylindrical hollow body and is indented along its longitudinal length at two opposite side to form the upper groove 81 and the lower groove 82 respectively. The upper groove 81 is arranged to receive the rack 7 and affixed the rack 7 into position. The lower groove 82 is a guiding rail for a left bearing connecting rod 16 and a right bearing connecting rod 17. A wire rope fastening sleeve 14 is provided at a rear end of the extensible tube 8.

The two parts structures of the left transmission guiding half cylinder member 10 and the right transmission guiding half cylinder member 22 are arranged for installation of a first bearing 20 at a tail end at the inner side and for the installation of the left bearing connecting rod 16 and the right bearing connecting rod 17 at the front end at the inner side. The first bearing 20, the left bearing connecting rod 16 and the right bearing connecting rod 17 are installed at the front end and the inner side of the left transmission guiding half cylinder member 10 and the right transmission guiding half cylinder member 22, then the left transmission guiding half cylinder member 10 and the right transmission guiding half cylinder member 22 are connected together form a cylindrical hollow sleeve. The two parts structure of the left bearing connecting rod 16 and the right bearing connecting rod 17 is designed for installation convenience. The left bearing connecting rod 16 and the right bearing connecting rod 17 are connected together after installation to form a rod structure having a rectangular cross-section. A second bearing 19 is provided at another end of the left bearing connecting rod 16 and the right bearing connecting rod 17.

A drive plate 11 has a front end positioned inside the hollow guiding rail 112 formed by the left transmission guiding half cylinder member 10 and the right transmission guiding half cylinder member 22 through a positioning sliding block 12. The drive plate 11 has a rear end fixedly connected to a position sleeve 13. The position sleeve 13 and the rear cylinder element 3 are fixedly connected together by the tail fastener 4. The middle hand grip cylinder element 2 is fixedly connected on the rear cylinder element 3.

The middle layer fixed sleeve element 9 is installed at the outer side of the extensible tube 8, the left transmission guiding half cylinder member 10 and the right transmission guiding half cylinder member 22. A front end of the middle layer fixed sleeve element 9 is restricted into position by a positioning protrusion 111 at an inner side of the front hand grip cylinder element 1. A rear end of the middle layer fixed sleeve element 9 is affixed into position to the left transmission guiding half cylinder member 10 and the right transmission guiding half cylinder member 22 by a rear end positioning sleeve 21.

The second bearing 19 is affixed into position at a front end of the lower grove 82 of the extensible tube 8. The first bearing 20 is affixed into position at the inner side and a tail end of the left transmission guiding half cylinder member 10 and the right transmission guiding half cylinder member 22. A wire rope 18 has one end affixed to the wire rope fastening sleeve 14 and another end extended to and passing around the first bearing 20, affixing the wire rope 18 and the drive plate 11 into position by the positioning sliding block 12 at the front end of the drive plate 11, then extending to and passing around the second bearing 19 at the front end and finally affixed at a rear end of the wire rope fastening sleeve 14.

Working principle of the present invention:

In the normal state, the rack 7 of the extensible tube 8 is engaged with the teeth structure 62 of the button 6 under the action of the tail spring 61 of the button 6 so that the telescopic rod 100 is in a fixed-length state.

When extension or retraction is required for length adjustment, the two hands of a user are placed on the upper cylinder member and the lower cylinder member 15 at the front end and the middle hand grip cylinder element 2 at the middle respectively. The button 6 is pressed downwardly so that the rack 7 of the extensible tube 8 at the front end is disengaged with the teeth structure 62 of the button 6 so that the extensible tube 8 can be extended or shortened freely. When the hands are pulled in opposite direction to extend the telescopic rod 100, the middle hand grip cylinder element 2 will drive the connecting rear cylinder element 3, the tail fastener 4, the position sleeve 13 which affixed the rear end of the drive plate 11, and the drive plate 11 to move and extend rearwardly. The drive plate 11 drives the connecting wire rope 18 through the positioning sliding block 12 to move and extend rearwardly, the wire rope 18 is driven by the first bearing 20 installed at the inner side and tail end of the left transmission guiding half cylinder member 10 and the right transmission guiding half cylinder member 22 and the second bearing 19 installed at the front end of the lower groove of the extensible tube 8 to pull the wire rope fastening sleeve 14 into movement so that the extensible tube 8 is extended forward towards the front end. Therefore, the tool, such as a household tool, cleaning tool or hand tool, which is connected to the threaded connecting head 5 is extended. When a desired length is reached, the button 6 is fixed into position so that the rack 7 of the extensible tube 8 is engaged with the teeth structure 62 of the button 6 again for fixing the length of the telescopic rod 100.

One skilled in the art will understand that the embodiment of the present invention as shown in the drawings and described above is exemplary only and not intended to be limiting.

It will thus be seen that the objects of the present invention have been fully and effectively accomplished. Its embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A multifunctional telescopic device, comprising:

an outermost layer which sequentially comprises a front hand grip cylinder element at a front end, a middle hand grip cylinder element at a middle, a rear cylinder element at a tail end opposite to the front end, and a tail fastener;

a middle layer which comprises a middle layer fixed sleeve element connecting between the front hand grip cylinder element and the middle hand grip cylinder element such that the middle hand grip cylinder element is capable of sliding movement along a longitudinal direction of the middle layer fixed sleeve element;

an innermost layer which comprises an extensible tube provided inside the front hand grip cylinder element and the middle hand grip cylinder element, the extensible tube comprising a threaded connecting head at a front end arranged for connecting to a tool head and a rack at a top side thereof, and is capable of sliding movement for length extension or length shortening initiated by a movement of the middle hand grip cylinder element wherein the front hand grip cylinder element comprises a button having a teeth structure arranged for engaging with the rack of the extensible tube at a fixed-length state at which a length of the multifunctional telescopic device is locked and for disengaging with the rack of the extensible tube at a length adjustment state at which the length of the multifunctional telescopic device is unlock for adjustment.

2. The multifunctional telescopic device according to claim 1, comprising a transmission arrangement linking the movement of the middle hand grip cylinder element to the extensible tube, wherein the transmission arrangement comprises a position sleeve fixedly connected inside the tail fastener; a drive plate positioned inside the rear cylinder element, a left transmission guiding half cylinder member and a right transmission guiding half cylinder member at the innermost layer supported by the middle layer fixed sleeve element; a positioning sliding block provided at the left transmission guiding half cylinder member and the right transmission guiding half cylinder member inside the front hand grip cylinder element; and a wire rope having one end connecting to the drive plate through the sliding block and another end connecting to the wire rope fastening sleeve which is positioned at the tail end of the extensible tube.

3. The multifunctional telescopic device according to claim 2, wherein the left transmission guiding half cylinder member and the right transmission guiding half cylinder member are connected together to form a complete cylindrical hollow sleeve and forming a hollow guiding rail therein, the drive plate has a front end affixed at the hollow guiding rail through the positioning sliding block.

4. The multifunctional telescopic device according to claim 3, wherein the extensible tube has a cylindrical hollow body and is indented along a longitudinal length thereof at two opposite top and bottom sides to form an upper groove and a lower groove respectively, the rack is positioned at the upper groove while a rod structure formed by a left bearing connecting rod and a right bearing connecting rod connecting together is guided by the lower groove and having one end fixedly connected to the front end of the left transmission guiding half cylinder member and the right transmission guiding half cylinder member and another end supporting a second bearing, which is positioned at an inner side of the front hand grip cylinder element.

5. The multifunctional telescopic device according to claim 4, wherein the rod formed by the left bearing connecting rod and the right bearing connecting rod structure has a rectangular cross-section.

6. The multifunctional telescopic device according to claim 5, wherein the front hand grip cylinder element comprises a positioning protrusion at the front end and inner side thereof for restricting a sliding movement of the middle layer fixed sleeve element.

7. The multifunctional telescopic device according to claim 6, wherein the front hand grip cylinder element is formed by two cylinder members connecting together.

8. The multifunctional telescopic device according to claim 6, where the button comprises a spring and the teeth structure is provided at a front inner side of the front hand grip cylinder element such that when the spring is pressed to compress, the teeth structure is disengaged from the rack to allow movement at the length adjustment state.

9. The multifunctional telescopic device according to claim 8, further comprising a second bearing affixed into position at a front end of the lower grove of the extensible tube, a first bearing affixed into position at an inner side and a tail end of the left transmission guiding half cylinder member and the right transmission guiding half cylinder member, wherein the wire rope is affixed to the wire rope fastening sleeve, extended to and passing around the first bearing, affixed by the positioning sliding block at the front end of the drive plate, then extended to and passing around the second bearing at the front end and finally affixed at a rear end of the wire rope fastening sleeve.

10. The multifunctional telescopic device according to claim 4, where the button comprises a spring and the teeth structure is provided at a front inner side of the front hand grip cylinder element such that when the spring is pressed to compress, the teeth structure is disengaged from the rack to allow movement at the length adjustment state.

11. The multifunctional telescopic device according to claim 10, further comprising a second bearing affixed into position at a front end of the lower grove of the extensible tube, a first bearing affixed into position at an inner side and a tail end of the left transmission guiding half cylinder member and the right transmission guiding half cylinder member, wherein the wire rope is affixed to the wire rope fastening sleeve, extended to and passing around the first bearing, affixed by the positioning sliding block at the front end of the drive plate, then extended to and passing around the second bearing at the front end and finally affixed at a rear end of the wire rope fastening sleeve.

12. The multifunctional telescopic device according to claim 2, wherein the extensible tube has a cylindrical hollow body and is indented along a longitudinal length thereof at two opposite top and bottom sides to form an upper groove and a lower groove respectively, the rack is positioned at the upper groove while a rod structure formed by a left bearing connecting rod and a right bearing connecting rod connecting together is guided by the lower groove and having one end fixedly connected to the front end of the left transmission guiding half cylinder member and the right transmission guiding half cylinder member and another end supporting a second bearing, which is positioned at an inner side of the front hand grip cylinder element.

13. The multifunctional telescopic device according to claim 12, wherein the rod formed by the left bearing connecting rod and the right bearing connecting rod structure has a rectangular cross-section.

14. The multifunctional telescopic device according to claim 12, wherein the front hand grip cylinder element comprises a positioning protrusion at the front end and inner side thereof for restricting a sliding movement of the middle layer fixed sleeve element.

15. The multifunctional telescopic device according to claim 2, wherein the front hand grip cylinder element comprises a positioning protrusion at the front end and inner side thereof for restricting a sliding movement of the middle layer fixed sleeve element.

16. The multifunctional telescopic device according to claim 15, wherein the front hand grip cylinder element is formed by two cylinder members connecting together.

17. The multifunctional telescopic device according to claim 2, where the button comprises a spring and the teeth structure is provided at a front inner side of the front hand grip cylinder element such that when the spring is pressed to compress, the teeth structure is disengaged from the rack to allow movement at the length adjustment state.

18. The multifunctional telescopic device according to claim 17, further comprising a second bearing affixed into position at a front end of the lower grove of the extensible tube, a first bearing affixed into position at an inner side and a tail end of the left transmission guiding half cylinder member and the right transmission guiding half cylinder member, wherein the wire rope is affixed to the wire rope fastening sleeve, extended to and passing around the first bearing, affixed by the positioning sliding block at the front end of the drive plate, then extended to and passing around the second bearing at the front end and finally affixed at a rear end of the wire rope fastening sleeve.

19. The multifunctional telescopic device according to claim 1, where the button comprises a spring and the teeth structure is provided at a front inner side of the front hand grip cylinder element such that when the spring is pressed to compress, the teeth structure is disengaged from the rack to allow movement at the length adjustment state.

20. The multifunctional telescopic device according to claim 19, further comprising a second bearing affixed into position at a front end of the lower grove of the extensible tube, a first bearing affixed into position at an inner side and a tail end of the left transmission guiding half cylinder member and the right transmission guiding half cylinder member, wherein the wire rope is affixed to the wire rope fastening sleeve, extended to and passing around the first bearing, affixed by the positioning sliding block at the front end of the drive plate, then extended to and passing around the second bearing at the front end and finally affixed at a rear end of the wire rope fastening sleeve.

* * * * *